United States Patent [19]

Miyagawa et al.

[11] 4,239,204

[45] Dec. 16, 1980

[54] CONSTRUCTION OF A COUNTING SECTION IN A PAPER COUNTING MACHINE

[75] Inventors: Tuyoshi Miyagawa; Junichi Arikawa, both of Tokyo, Japan

[73] Assignee: Laurel Bank Machine Co., Ltd., Tokyo, Japan

[21] Appl. No.: 31,129

[22] Filed: Apr. 18, 1979

[30] Foreign Application Priority Data

Apr. 25, 1978 [JP] Japan ..... 53-56341[U]

[51] Int. Cl.[3] ..... B65H 1/02

[52] U.S. Cl. ..... 271/171; 271/8 A; 271/95

[58] Field of Search ..... 271/8 R, 8 A, 35, 145, 271/171; 235/925 B

[56] References Cited

U.S. PATENT DOCUMENTS

| | | | |
|---|---|---|---|
| 3,241,757 | 3/1966 | Uchihama et al. | 271/95 X |
| 3,983,367 | 9/1976 | Kondo et al. | 235/925 B |
| 4,056,193 | 11/1977 | Yoshida | 271/95 X |

FOREIGN PATENT DOCUMENTS 105995 8/1977 Japan .

*Primary Examiner*—Robert W. Saifer
*Attorney, Agent, or Firm*—Fleit & Jacobson

[57] ABSTRACT

There is provided a paper counting machine wherein a stack of papers charged on a holder is sucked and deflected one sheet at a time by a number of suction shafts to be counted, characterized in that a counting section including the holder and the suction shafts is disposed within a recess formed on the top of the body of the machine, noise-proof covers are openably mounted on the body above the recess to seal or release the counting section, and the upper edges of the body in front of the recess is constructed to be in substantially a same horizontal plane as the upper surface of the supporting plate of the holder. Therefore, when the larger size papers are charged on the supporting plate with the covers opened, the portions of the lower edges of the larger size papers are supported on the upper edges of the body. In the case of the small size papers, the papers can be counted with the covers closed.

5 Claims, 6 Drawing Figures

CONSTRUCTION OF A COUNTING SECTION IN A PAPER COUNTING MACHINE

BACKGROUND OF THE INVENTION

This invention relates to a construction of a counting section in a paper counting machine.

There has been known a paper counting machine constructed so that a stack of papers charged on a holder is sucked and deflected one sheet at a time by a number of suction shafts to count a stack of papers. Although in such conventional machines, a dust collecting device is provided, a cover for sealing the counting section is not provided. Therefore, dust, such as paper particles, produced during counting operation is not completely removed by the dust collecting device and escapes here and there. Furthermore, since, in such machines, noise is also generated during a counting operation, the noise imparts discomfort to an operator and to people in the immediate vicinity. For a long time there has been no consideration of an alternative plan to counter these disadvantages. The applicant recently proposed as a counterplan the provision of a pair of covers on a counting section in a paper counting machine in order to prevent the escape of noise and dust. (see Japanese Utility Model Application No. 105995/1977).

However, since the above-mentioned paper counting machine with covers is designed to count the number of sheets of paper of a relatively small size, such as currency notes, which do not obstruct the opening and closing operations of the covers, there is no problem in counting such currency notes. However, the paper counting machine cannot be used for a stack of papers of a relatively large size which would obstruct the closing of the cover.

SUMMARY OF THE INVENTION

It is, therefore, an object of the present invention to provide a construction of a counting section of a paper counting machine which can be used for stacks of papers, either small-sized or large-sized.

Another object of the present invention is to provide a construction of a counting section of a paper counting machine of the above type in which a stack of papers can be charged horizontally and stably during the counting of a stack of large-size papers.

It is a further object of the present invention to provide a construction of a counting section of a paper counting machine of the above type in which the paper counting machine can be used to count a stack of paper with a pair of covers, whether opened or closed.

In accordance with the present invention, there is provided a paper counting machine wherein a stack of papers charged on a holder is sucked and deflected one sheet at a time by a number of suction shafts to be counted, characterized in that a counting section including the holder and the suction shafts is disposed within a recess formed on the top of the body of the machine, noise-proof covers are openably mounted on the body above the recess to seal or release the counting section, and the upper edges of the body in front of the recess are constructed to be in substantially a same horizontal plane as the upper surface of the supporting plate of the holder whereby when the larger size of the papers is charged on the supporting plate with the covers being opened, the portions of the lower edges of the larger size papers are supported on the upper edges of the body.

BRIEF DESCRIPTION OF THE DRAWINGS

Other objects and advantages of the present invention will become apparent from the following description made with reference to the accompanying drawings, in which.

DESCRIPTION OF THE PREFERRED EMBODIMENT

Figure 1:
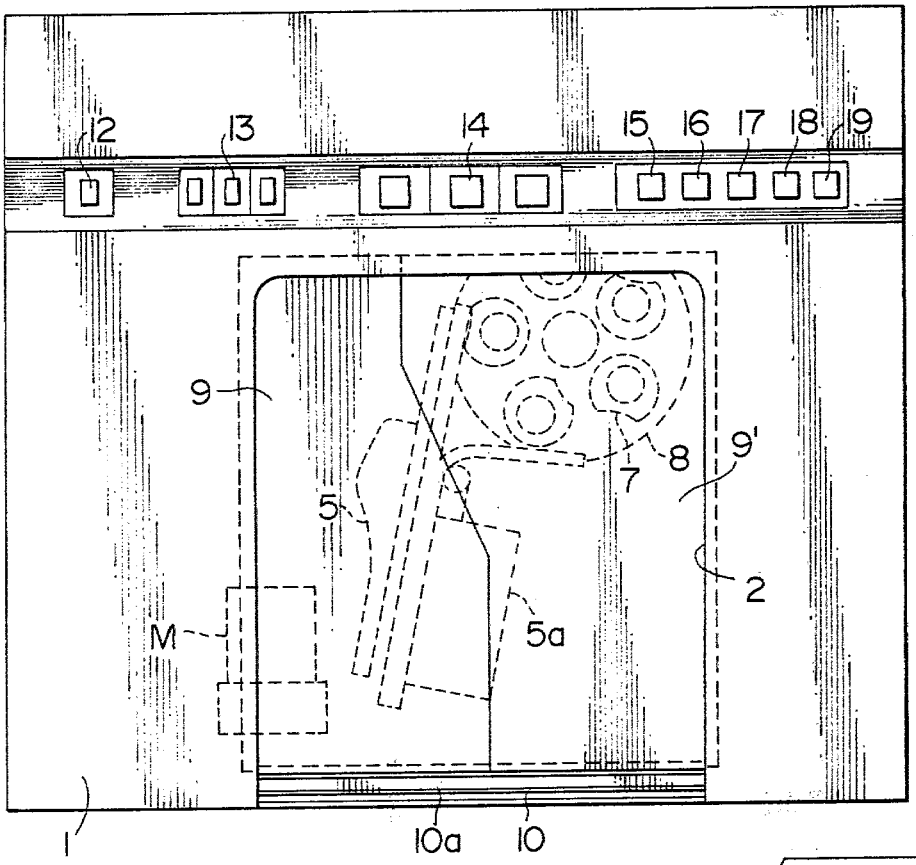
FIG. 1 is a top plan view of the paper counting machine with covers closed.

One embodiment of the present invention will now be described in detail with reference to the accompanying drawings.

Referring to FIGS. 1 through 4 and 6, an upper surface (1) of machine body is provided with an opening (2), under which a recess (3) is formed. Within the groove (3), a counting section is positioned. The counting section includes a holder (5) having a supporting plate (5*a*) which can support the papers thereon and mounted on the machine body so as to be rotated between a closed position (a) and an open position (b), a supporting rod (6) cooperating with the holder (5) to sandwich and hold the papers between the supporting rod (6) the holder (5), and a rotary cylinder (8) provided with a number of suction shafts or heads (7). Since the arrangement and operations of these members are conventional, the details thereof will be herein omitted.

A pair of noise-proof covers (9), (9') are mounted on the machine body so as to open and close the opening (2) above the recess (3). In front of the recess (3) and in the lower forward position of the opening (2), a rail (10) is mounted laterally. The rail (10) functions to guide the covers (9), (9') and two covers slide inside the groove of the rail. Since device for driving the covers (9), (9') is described in detail in the above-mentioned Japanese Utility Model Application, the construction thereof will be herein explained diagrammatically. A belt, not shown, which is driven by a cover driving motor (M) mounted within the recess (3) is put on pulleys (11) which are disposed on opposite sides of the rails (10). The belt is connected at a suitable respective point to each cover (9), (9') and the covers are moved through the motor (M) in opposite directions to open or close the opening (2).

Figure 3:
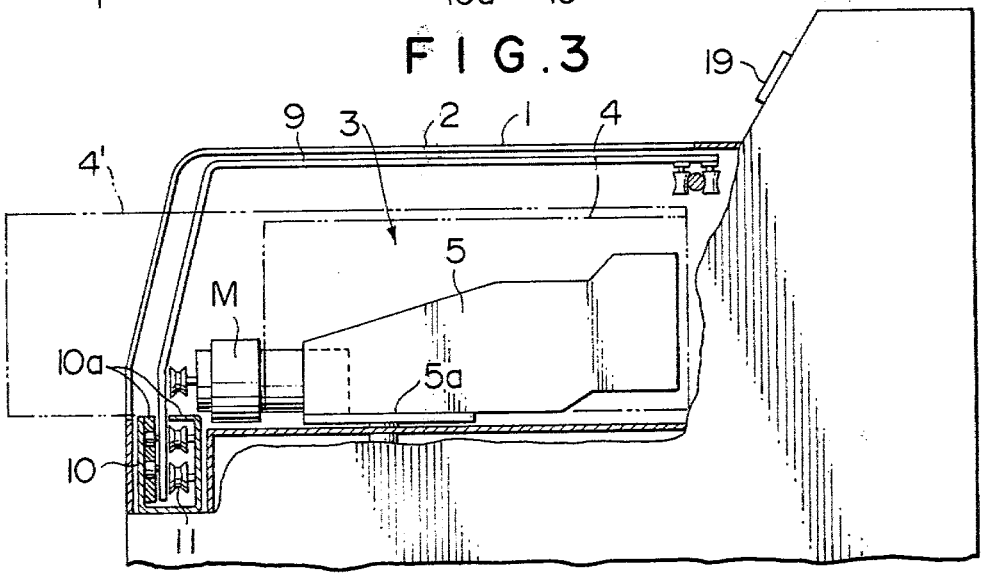
FIG. 3 is a cross-sectional side view showing the counting section of the paper counting machine with a part broken away.
Figure 2:
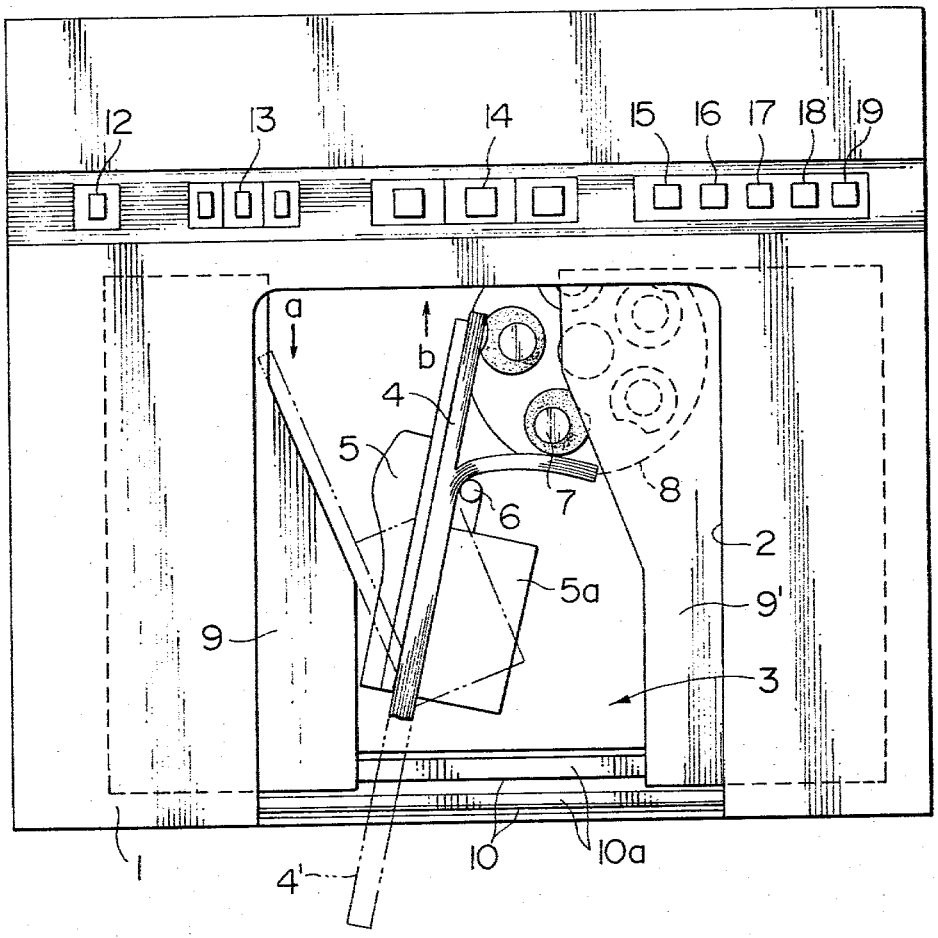
FIG. 2 is a top plan view of the paper counting machine with covers opened.
Figure 4:
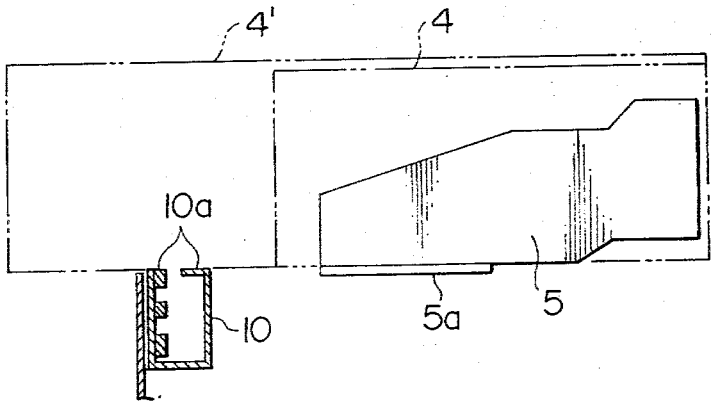
FIG. 4 is an enlarged side view showing the interior of the counting section.

The upper ends (10*a*) of the rail are disposed so as to be in the same horizontal plane as the supporting upper surface of the supporting plate (5*a*) (see FIGS. 3 and 4). In the above construction according to the present invention, when a stack of papers of a large size is supported on the holder with the covers opened, the portions of the lower edges of the papers are supported on the upper ends (10*a*) and, therefore, the papers are positioned in a stable horizontal state. This results in a good counting operation and is preferably used with an autostart switch, as hereinafter described.

Provided on the inclined surface of the machine body behind the upper surface (1), is a control console which includes a main switch (12), a digital switch (13), a counter display (14), a CK(check) mode switch (15), a BT (batch) modes switch (16), an AD (adding) mode switch (17), a noise-proof cover switch (18) and an autostart switch (19). The check, batch and adding mode switches are constructed so that only one of them is selected.

The driving control of the noise-proof covers will now be explained with reference to the FIG. 5. The motor (M) drives the covers closed when the motor is supplied between terminals (A) and (B) with a power (AC 100 volt) and drives the covers open when the motor is supplied between its terminals (A) and (C) with a power. A cover closed position detecting switch (20) is a microswitch positioned within the counting section so that its contacts are closed when the covers are completely closed. A switch (21) is representative of normally closed contacts of a relay (RY) and it is opened when the relay (RY) is energized. The cover switch (18) is provided on the control console and is manually operated. The cover switch is manually closed when the covers are used and is opened when the covers are not used. A holder closed position detecting switch (22) is a microswitch positioned within the counting section so that its contacts are closed when the holder is closed. The above-mentioned switches (20), (21), (18) and (22) form a cover closing control circuit (25) and since the motor (M) is supplied between its terminals (A) and (B) with power when all the switches of the cover closing control circuit (25) are closed, the motor is actuated to close the covers.

A cover opened position detecting switch (23) is a microswitch positioned within the counting section so that its contacts are opened when the covers are opened. A switch (24) is representative of normally opened contacts of the relay (RY) and is closed when the relay (RY) is energized. The above-mentioned switches (23) and (24) form a cover opening control circuit (26) and since the motor (M) is supplied between its terminals (A) and (C) with power when all the switches of the cover opening control circuit (26) are closed, the motor is actuated to open the covers.

The relay (RY) is controlled by an RY control circuit (27) which is composed of a combination of contacts of the check mode switch (15) and the batch mode switch (16) and a portion of contacts of other relays used in the operation of the counting machine. By the combination of these contacts, the RY control circuit (27) controls the relay (RY) in response to the on or off of the main switch (12), the start or end of counting, etc. The manner of the control will hereinafter be explained in accordance with the sequence of the operation of the counting section.

In operation of the counting section in accordance with the invention, when the main switch (12) is off, the holder is closed. At that time, the covers are also usually closed. However, if when the cover switch (18) is off, the main switch (12) is switched off, the covers are still opened. Since this special case is not directly related to the present invention, the details thereof will be omitted. When the main switch (12) is turned on, the holder (5) is opened (the control circuit of the holder is not shown). At that time, since the covers are in the closed state, the cover opened position detecting switch (23) is in the closed state. The switch (24) is closed since the relay (RY) is energizing through the RY control circuit (27) by the switching on of the main switch (12). Therefore, the power is fed through the cover opening control circuit (26) to the motor and thus the covers are caused to be opened. Further, just when the covers are about to be opened, the cover closed position detecting switch (20) is caused to be closed and when the covers are completely opened, the cover opened position detecting switch (23) is caused to be opened. Thus, due to the operation of the latter, when the covers become completely opened, the opening movement of the covers is stopped. Consequently, the counting section becomes ready for a counting operation.

Although, therefore, the stack of papers is charged on the holder (15) and counted, the case involving stacks of small size papers such as currency notes which permits the covers to be closed will be explained first. Counting modes include an adding mode, a check mode and a batch mode. In the adding mode, counting values are accumulated sequentially and the holder and the covers are opened just after the end of counting. In the check mode, whether a predetermined number of papers is present or not is checked. When a set number coincides with the counted number, the holder and the covers are opened. However, if it is not, the holder and the covers or only the covers are kept closed in order to let the operator know the matter. The holder and the covers are opened through a reset switch, not shown, by the operator. In the batch mode, a predetermined number of papers is separated from the other. As the counting value reaches the set number, the counting is stopped and a separator arm, not shown, is caused to be inserted between the already counted papers and the non-counted papers. Thereafter, the covers are automatically opened and the holder is opened through the reset switch by the operator.

In operation of the adding mole, the cover switch (18) is switched on and the stack of papers is charged on the holder. In such a condition, a start circuit is actuated automatically in the case that the autostart switch (19) is on or is actuated manually when a start switch, not shown, is switched on. For this, the holder is caused to be closed. The holder closed position detecting switch (22) detects its condition and is caused to be closed. In the meanwhile, since the RY control circuit is constructed so that it does not energize the relay (RY) from the start of counting to the end thereof, the switch (21) is caused to be closed. The cover closed position detecting switch (20) is in its closed condition, as mentioned above. Thus, since all the switches (20), (21), (18) and (22) are now in their closed conditions, a power is supplied between the terminals (A) and (B) of the motor through the cover closing control circuit (25) to close the covers. The closed condition of the covers continues until the end of counting. Further, when the covers begin to be moved to be closed, the cover opened position detecting the switch (23) is caused to be closed and when the covers are completely closed, the cover closed position detecting switch (20) is caused to be opened. Thus due to the operation of the latter, when the covers become completely closed, the motor is not energized and the closing movement of the covers is stopped.

When the holder is closed, as mentioned above, the counting starts. Since the operation of counting is conventional, it will be herein described diagrammatically. The stack of papers which is sandwiched and supported between the holder (5) and the supporting rod (6) are sucked and deflected at the end portions thereof one at a time in accordance with the operation of the rotary cylinder (8) provided with the suction shafts (7) and thereby being counted.

When the counting of the stack of the papers is completed, the relay (RY) is energized through the RY control circuit to close the switch (24) and to open the switch (21). Since the cover closed position detecting switch (23) has been closed, as mentioned above, a power is supplied between the terminals (A) and (C) of the motor (M) through the cover closing control circuit (26) to open the covers. Further the holder is adapted to be opened at the time of the end of counting. Thus, the machine is returned to be ready for the next operation of counting.

In the check mode, its operation is similar to that of the above-mentioned adding mode until the end of counting. When the counted value coincides with the preset value at the time of the end of counting, the relay (RY) is energized soon to open the covers and the holder. When the counted value does not coincide with the preset value, the relay (RY) is not energized so as to maintain the covers and the holder in their closed conditions. Further, only the holder may be adapted to be maintained in its closed condition. The opening of the covers and the holder or only the holder is made through a reset switch, not shown.

In the batch mode, its operation is also similar to that of the adding mode. When the counting of a predetermined number of the papers is completed, the separator arm is inserted between the counted papers and the non-counted papers. Thereafter the relay (RY) is energized through the RY control circuit to open the covers. Further, the holder is caused to be opened after the separator arm is returned to its initial position by the switching-in of the reset switch.

Finally, the case involving the larger size papers which are counted with the covers opened will be explained. In this case, the cover switch (18) is not switched on. For this, since the cover switch forming the portion of the cover closing control circuit (26) is maintained in its opened condition, a power is not supplied between the terminals (A) and (B) of the motor at any time, and, therefore, the covers are maintained in their opened conditions. Since the holder is controlled by a separate control circuit, its operation is similar to that of each mode, as mentioned above. Since the covers are in their opened condition, when the stack of larger size papers (4') is charged on the holder, the papers (4') project from the recess (3) as shown in phantom lines of FIGS. 2 through 4. However, since the upper edges (10*a*) are in the same horizontal plane as the upper surface or supporting surface of the supporting plate (5*a*), the papers are stably held so that the portions of the papers are supported on the upper edges (10*a*). This is preferable especially when the autostart switch is in use as well as during counting. Because the autostart switch (19) is adapted to detect the portions of the papers in order to be actuated when the papers are normally positioned or horizontally positioned. Therefore, if the papers are inclinedly positioned, the autostart switch would not detect the presence of the papers.

Figure 5:
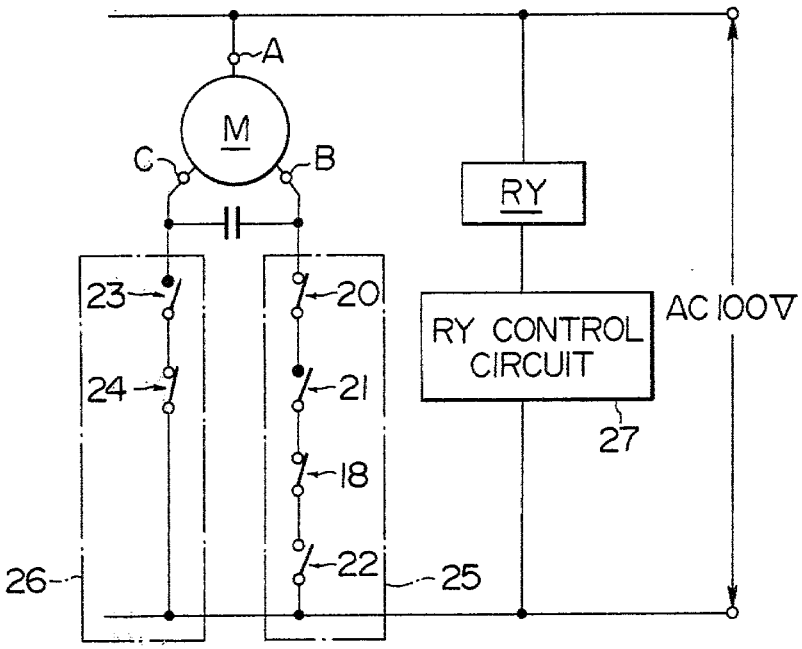
FIG. 5 is a circuit for controlling the opening and closing of the covers.
Figure 6:
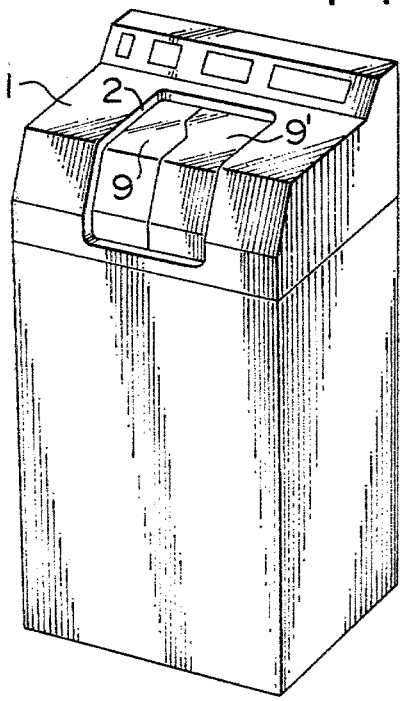
FIG. 6 is a perspective view showing the whole construction of the paper counting machine.

The conditions of the switches as shown in FIG. 5 indicate that the counter is reset, the cover switch is on, the covers are opened and the counting has been completed.

When the use of the machine is completed, the main switch (12) is switched off to close the holder and the covers in their initial positions.

What is claimed is:

1. A paper counting machine wherein a stack of papers charged on a holder is sucked and deflected one sheet at a time by a number of suction shafts to be counter, characterized in that a counting section including the holder and the suction shafts is disposed within a recess formed on the top of the body of the machine, noise-proof covers are openably mounted on the body above the recess to seal or release the counting section, and an upper edge of the body in front of the recess is constructed to be in substantially a same horizontal plane as the upper surface of the supporting plate of the holder whereby when the larger size of the papers is charged on the supporting plate with the covers being opened, the portions of the lower edges of the larger size papers are supported on the upper edge of the body.

2. A paper counting machine a set forth in claim 1, wherein small size papers are counted with the covers being closed.

3. A paper counting machine as set forth in claim 1, further comprising a laterally extending rail positioned in front of the recess holding the counting section for guiding movement of the covers, and wherein the upper edge of the body in front of the recess that is in substantially the same horizontal plane as the upper surface of the supporting plate of the holder is defined by a top surface of said rail.

4. A paper counting machine as set forth in claim 1, wherein two spaced-apart edges are provided for supporting lower edges of larger size papers.

5. A paper counting machine as set forth in claim 4, further comprising spaced-apart laterally extending rails positioned in front of the recess holding the counting section for guiding movement of the covers, and wherein the upper edges of the body in front of the recess that are in substantially the same horizontal plane as the upper surface of the supporting plate of the holder are defined by top surfaces of said rails.

* * * * *